US011059544B2

(12) United States Patent
Zhang et al.

(10) Patent No.: US 11,059,544 B2
(45) Date of Patent: Jul. 13, 2021

(54) INBOARD EXTENDED COLUMN SEMI-SUBMERSIBLE

(71) Applicant: Keppel FloaTEC, LLC, Houston, TX (US)

(72) Inventors: Xinyu Zhang, Katy, TX (US); Parthasarathy Krishnaswamy, Katy, TX (US); Zhengyong Zhong, Katy, TX (US); Surya P. Banumurthy, Katy, TX (US)

(73) Assignee: KEPPEL FLOATEC, LLC, Houston, TX (US)

( * ) Notice: Subject to any disclaimer, the term of this patent is extended or adjusted under 35 U.S.C. 154(b) by 26 days.

(21) Appl. No.: 16/436,382

(22) Filed: Jun. 10, 2019

(65) Prior Publication Data

US 2020/0231251 A1 Jul. 23, 2020

Related U.S. Application Data

(60) Provisional application No. 62/794,397, filed on Jan. 18, 2019.

(51) Int. Cl.
*B63B 1/10* (2006.01)
*B63B 35/44* (2006.01)

(52) U.S. Cl.
CPC ..... *B63B 1/107* (2013.01); *B63B 35/44* (2013.01); *B63B 2241/08* (2013.01)

(58) Field of Classification Search
CPC ..... B63B 1/107; B63B 35/44; B63B 2241/08
See application file for complete search history.

(56) References Cited

U.S. PATENT DOCUMENTS 6,830,413 B2 12/2004 Wybro et al.
7,055,447 B1 * 6/2006 Bekker ..... B63B 27/30 114/151
8,807,062 B2 * 8/2014 Tahar ..... B63B 35/4413 114/265
9,725,137 B2 8/2017 Rijken
10,029,760 B2 7/2018 Muehlner et al.
(Continued)

FOREIGN PATENT DOCUMENTS

EP 0124338 A1 11/1984

OTHER PUBLICATIONS

International Search Report and Written Opinion issued in International Application No. PCT/US2019/035581, dated Sep. 17, 2019 (12 pages).

(Continued)

*Primary Examiner* — S. Joseph Morano
*Assistant Examiner* — Jovon E Hayes
(74) *Attorney, Agent, or Firm* — Patterson + Sheridan, LLP

(57) ABSTRACT

Aspects of the present disclosure relate generally to apparatus for semi-submersibles, including hulls of semi-submersibles. In one implementation, a hull for a semi-submersible includes a pontoon having one or more sides, and a plurality of columns extending upwards from the pontoon and configured to support a topsides. Each one of the plurality of columns has a cross section that is in a plane perpendicular to an axial centerline of the respective one of the plurality of columns. The cross section includes a first portion being rectangular in shape and a second portion being triangular in shape and having an apex that extends inboard from the first portion.

15 Claims, 8 Drawing Sheets

(56) References Cited

U.S. PATENT DOCUMENTS

| | | | | |
|---|---|---|---|---|
| 2002/0090270 | A1* | 7/2002 | Malcolm | B63B 1/107 405/195.1 |
| 2009/0229505 | A1* | 9/2009 | Williams | B63B 1/107 114/265 |
| 2009/0235856 | A1* | 9/2009 | Mansour | B63B 21/50 114/265 |
| 2010/0288178 | A1* | 11/2010 | Mansour | B63B 39/00 114/265 |
| 2012/0285361 | A1* | 11/2012 | Rijken | B63B 1/107 114/265 |
| 2013/0000541 | A1* | 1/2013 | Rijken | B63B 21/502 114/265 |
| 2013/0319314 | A1* | 12/2013 | Wang | B63B 35/4413 114/265 |
| 2014/0305363 | A1* | 10/2014 | Knecht | B63B 35/44 114/265 |
| 2015/0298775 | A1* | 10/2015 | Muehlner | B63B 1/107 114/265 |
| 2016/0251059 | A1 | 9/2016 | Muehlner et al. | |
| 2017/0313390 | A1* | 11/2017 | Linder | B63B 35/4413 |
| 2020/0231251 | A1* | 7/2020 | Zhang | B63B 1/107 |

OTHER PUBLICATIONS

Mansour, Alaa M. et al., "Column Configuration and Wave Enhancement in the Wellbay of Offshore Floating Production Units", The Society of Naval Architects and Marine Engineers, Feb. 2016, pp. 1-10.

* cited by examiner

INBOARD EXTENDED COLUMN SEMI-SUBMERSIBLE

CROSS-REFERENCE TO RELATED APPLICATIONS

This application claims benefit of U.S. provisional patent application Ser. No. 62/794,397, filed Jan. 18, 2019, which is herein incorporated by reference.

BACKGROUND

Field

Aspects of the present disclosure relate generally to apparatus for semi-submersibles, including hulls of semi-submersibles.

Description of the Related Art

Semi-submersibles are used in the oil and gas industry, particularly in offshore operations relating to exploration, drilling, and/or production of hydrocarbons. Semi-submersibles can experience issues of hydrodynamic performance arising from the motion response of the platform due to conditions of the ocean. These issues can be affected by spacing between the columns of a hull of a semi-submersible, and/or spacing between the sides of a pontoon of the semi-submersible. Reducing the spacing between the columns of the hull can result in reduced spacing between sides of a pontoon, which can negatively affect hydrodynamic performance. Reducing spacing between columns can also reduce the metacentric height of the semi-submersible. What is more, an increase in the spacing between sides of the pontoon is limited by the spacing between the columns, which is limited by the size, weight, and/or cost of the topsides.

Therefore, there is a need for improved hulls and semi-submersibles having the same.

SUMMARY

Aspects of the present disclosure relate generally to hulls of semi-submersibles, and semi-submersibles having the same.

In one implementation, a hull for a semi-submersible includes a pontoon having one or more sides, and a plurality of columns extending upwards from the pontoon and configured to support a topsides. Each one of the plurality of columns has a cross section that is in a plane perpendicular to an axial centerline of the respective one of the plurality of columns. The cross section includes a first portion being rectangular in shape and a second portion being triangular in shape and having an apex that extends inboard from the first portion.

In one implementation, a hull for a semi-submersible includes a pontoon having one or more sides, and a plurality of columns extending upwards from the pontoon and configured to support a topsides. Each one of the plurality of columns has a cross section that is in a plane perpendicular to an axial centerline of the respective one of the plurality of columns. The cross section includes a first portion, a second portion having an apex that extends inboard from the first portion, and at least five sides.

In one implementation, a hull for a semi-submersible includes a pontoon having four sides and four corners. Each of the four sides has an inner edge and an outer edge, the inner edges of the four sides defining an inner perimeter of the pontoon. The hull also includes four columns extending upwards from the pontoon and configured to support a topsides, each one of the four columns being disposed at one of the four corners of the pontoon. Each one of the four columns has an inner edge disposed within the inner perimeter of the pontoon, an outer edge, and a cross section that is in a plane perpendicular to an axial centerline of the respective one of the plurality of columns. The cross section includes a first portion being rectangular in shape and a second portion being triangular in shape and having an apex that extends inboard from the first portion.

BRIEF DESCRIPTION OF THE DRAWINGS

So that the manner in which the above recited features of the disclosure can be understood in detail, a more particular description of the disclosure, briefly summarized above, may be had by reference to implementations, some of which are illustrated in the appended drawings. It is to be noted, however, that the appended drawings illustrate only common implementations of this disclosure and are therefore not to be considered limiting of its scope, for the disclosure may admit to other equally effective implementations.

Figure 1:
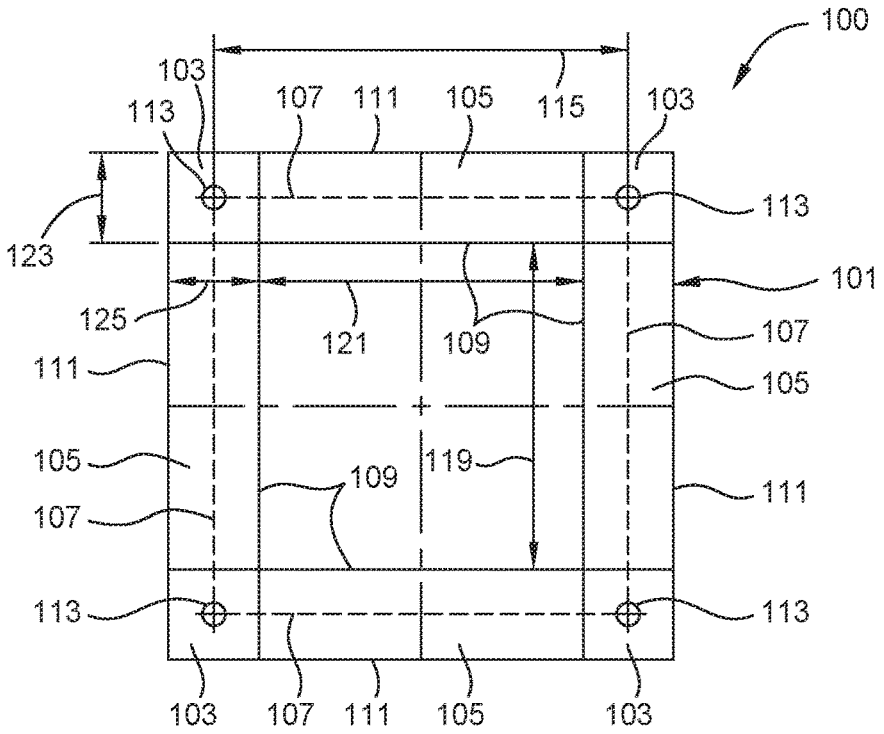
FIG. 1 (PRIOR ART)
FIG. 1 illustrates a conventional hull of a semi-submersible.

To facilitate understanding, identical reference numerals have been used, where possible, to designate identical elements that are common to the figures. It is contemplated that elements disclosed in one implementation may be beneficially utilized on other implementations without specific recitation.

DETAILED DESCRIPTION

Aspects of the present disclosure relate generally to semi-submersibles, including hulls of semi-submersibles.

FIG. 1 illustrates a conventional hull 100 of a semi-submersible. The hull 100 includes columns 103 connected to a pontoon 101. Each of the columns 103 includes an axial centerline 113 of the respective column 103. Axes 107 connect the axial centerlines 113 of the columns 103. The pontoon 101 includes four sides 105, each of which includes an inner edge 109 and an outer edge 111. A center-to-center spacing 115 is measured between the axial centerlines 113 of the columns 103. A pontoon spacing width 119 is measured between the inner edges 109 of two of the four sides 105 that are opposite of each other. A pontoon spacing length 121 is measured between the inner edges 109 of opposing sides 105. Each of the columns 103 includes a cross-sectional area defined by a column width 123 and a column length 125. In the configuration shown in FIG. 1, the pontoon spacing width 119 and the pontoon spacing length 121 also correspond to the respective support point width and the support point length for the columns 103.

Figure 2:
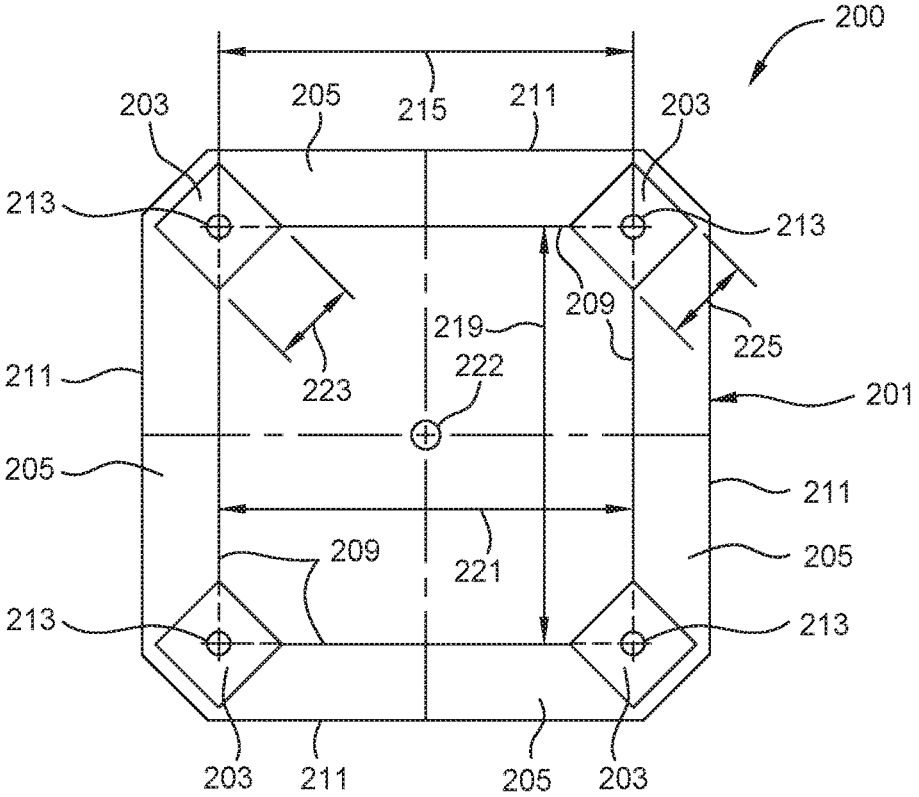
FIG. 2 (PRIOR ART)
FIG. 2 illustrates a conventional hull of a semi-submersible.

FIG. 2 illustrates a conventional hull 200 of semi-submersible. The hull 200 includes columns 203 connected to a pontoon 201. The pontoon 201 includes four sides 205. Each of the sides 205 of the pontoon 201 includes an inner edge 209 and an outer edge 211. The pontoon 201 includes a pontoon spacing width 219 measured between the inner edges 209 of opposing sides 205. The pontoon 201 also includes a pontoon spacing length 221 measured between the inner edges 209 of the other two of the four sides 205 that are opposite of each other.

The columns 203 are similar to the columns 103 illustrated in FIG. 1, but are each rotated about a respective axial centerline 213 by 45 degrees towards a center 222 of the hull 200. The rotated columns 203 allow for a pontoon 201 having a pontoon spacing width 219 that is wider than the pontoon spacing width 119 illustrated in FIG. 1. The rotated columns 203 also allow for a pontoon 201 having a pontoon spacing length 221 that is longer than the pontoon spacing length 121 illustrated in FIG. 1. However, the support points of the columns 203 can be spaced farther from each other than the support points of the columns 103 illustrated in FIG. 1. The larger spacing between support points results in a larger, more complex, and/or heavier topsides for the semi-submersible of which the hull 200 is a part and negatively affects the hydrodynamic performance of the semi-submersible. Moving the columns 203 closer to each other would reduce the pontoon spacing width 219 and/or the pontoon spacing length 221 and negatively affect hydrodynamic performance.

A center-to-center spacing 215 is measured between the axial centerlines 213 of the columns 203. The center-to-center spacing 215 is the same as the center-to-center spacing 115 illustrated in FIG. 1. Each of the columns 203 includes a cross-sectional area defined by a column width 223 and a column length 225. The cross-sectional area of the columns 203 is the same as the cross-sectional area of the columns 103 illustrated in FIG. 1.

Figure 3A:
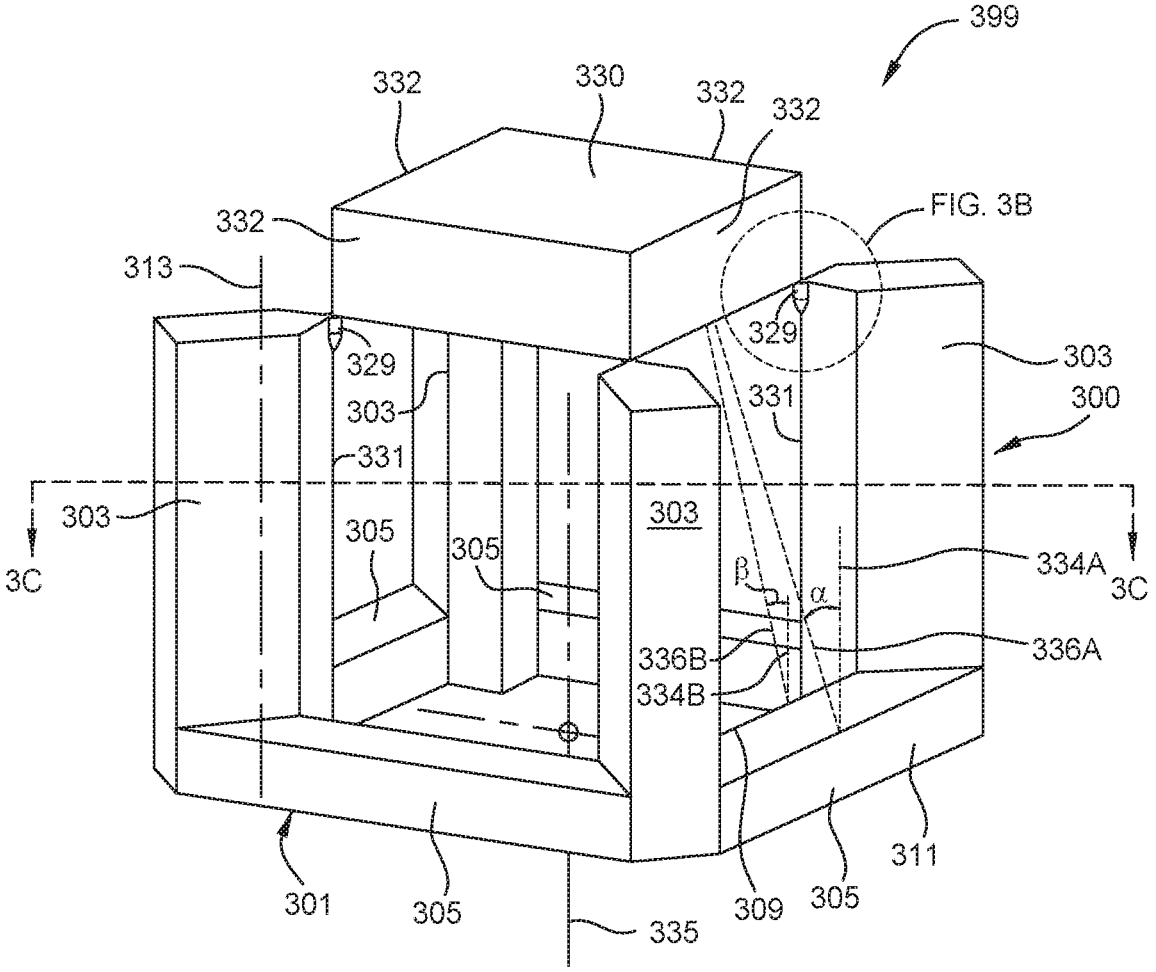
FIG. 3A illustrates a schematic isometric view of a semi-submersible having a hull, according to one implementation.

FIG. 3A illustrates a schematic isometric view of a semi-submersible 399 having a hull 300, according to one implementation. The semi-submersible 399 also includes a topsides 330 (sometimes referred to as a deck) disposed on top of the hull 300. The topsides 330 may include oil and gas equipment, such as production equipment or drilling equipment disposed thereon. The hull 300 includes a plurality of columns 303 (four are shown) that extend upwards from a pontoon 301, each disposed at a respective one of four corners of the pontoon 301. The pontoon 301 includes one or more sides 305, such as at least two sides 305 (sometimes referred to as separate pontoons). The pontoon 301 includes four sides 305 disposed in a rectangular arrangement. The pontoon 301 includes four corners. The columns 303 connect to the pontoon 301 at a bottom end of the columns 303 (forming nodes), and connect to the topsides 330 at a top end of the columns 303. The topsides 330 is supported by the columns 303 at an upper end thereof. The columns 303 are oriented vertically such that an axial centerline 313 of each column 303 is parallel to a center axis 335 of the hull 300 that extends vertically. At least a portion of each column 303 between the topsides 330 and the pontoon 301 is disposed vertically and parallel to the center axis 335 that extends vertically. The vertical profile of the columns 303 incurs efficiencies and lower costs because angling the profile of the columns 303 incurs manufacturing difficulties and high manufacturing costs. The topsides 330 is rectangular and includes four sides 332 that define an outer perimeter of the topsides 330. However, other topsides configurations are also contemplated.

The arrangement of the columns 303, pontoon 301, and topsides 330 allows for a beneficial hang-off angle. A first angle $\alpha$ is measured between a vertical axis 334A extending from an upper end of an outer edge 311 of a side 305 of the pontoon 301 and a line of sight 336A extending from the same upper end of the same outer edge 311 and a lower end of a corresponding side 332 of the topsides 330. In one example, the first angle $\alpha$ is within a range of 17 degrees to 19 degrees, such as 18 degrees. A second angle $\beta$ is measured between a vertical axis 334B extending from an upper end of an inner edge 309 of a side 305 of the pontoon 301 and a line of sight 336B extending from the same upper end of the same inner edge 309 and a lower end of a corresponding side 332 of the topsides 330. In one example, the second angle $\beta$ is within a range of 6 degrees to 9 degrees, such as 7 degrees to 9 degrees, such as 8 degrees. One or more of the first angle $\alpha$ and/or the second angle $\beta$ allow for a beneficial hang-off angle, such as a hang-off angle of risers that are installed on the semi-submersible 399. The first angle $\alpha$ and/or the second angle $\beta$ also promote ease of installation of equipment on the semi-submersible 399, such as ease of installation of risers.

In one example, the sides 332 are positioned inboard of respective inner sidewalls of the sides 305.

Figure 3B:
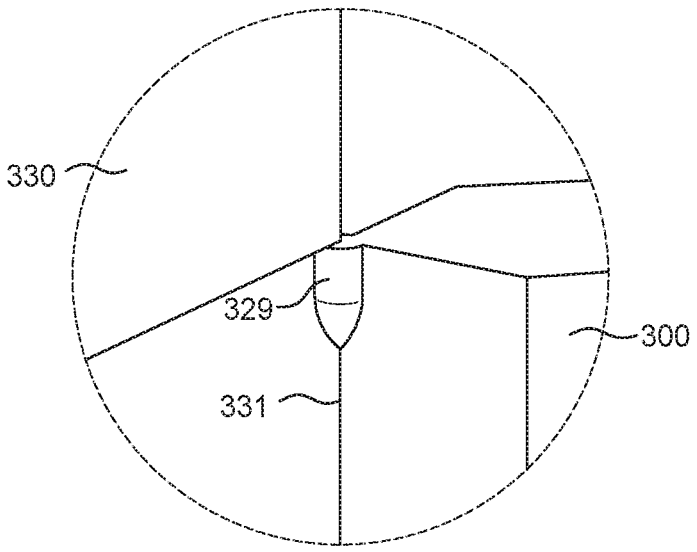
FIG. 3B illustrates an enlarged schematic view of the schematic isometric view illustrated in FIG. 3A, according to one implementation.

FIG. 3B illustrates an enlarged schematic view of the schematic isometric view illustrated in FIG. 3A, according to one implementation. The topsides 330 is mounted to the columns 303 through deck posts 329. A deck post 329 is disposed on an apex 331 of each one of the four columns 303. The deck posts 329 define support points on the columns 303 that support the topsides 330. The deck posts 329 are cylindrical in shape.

Figure 3C:
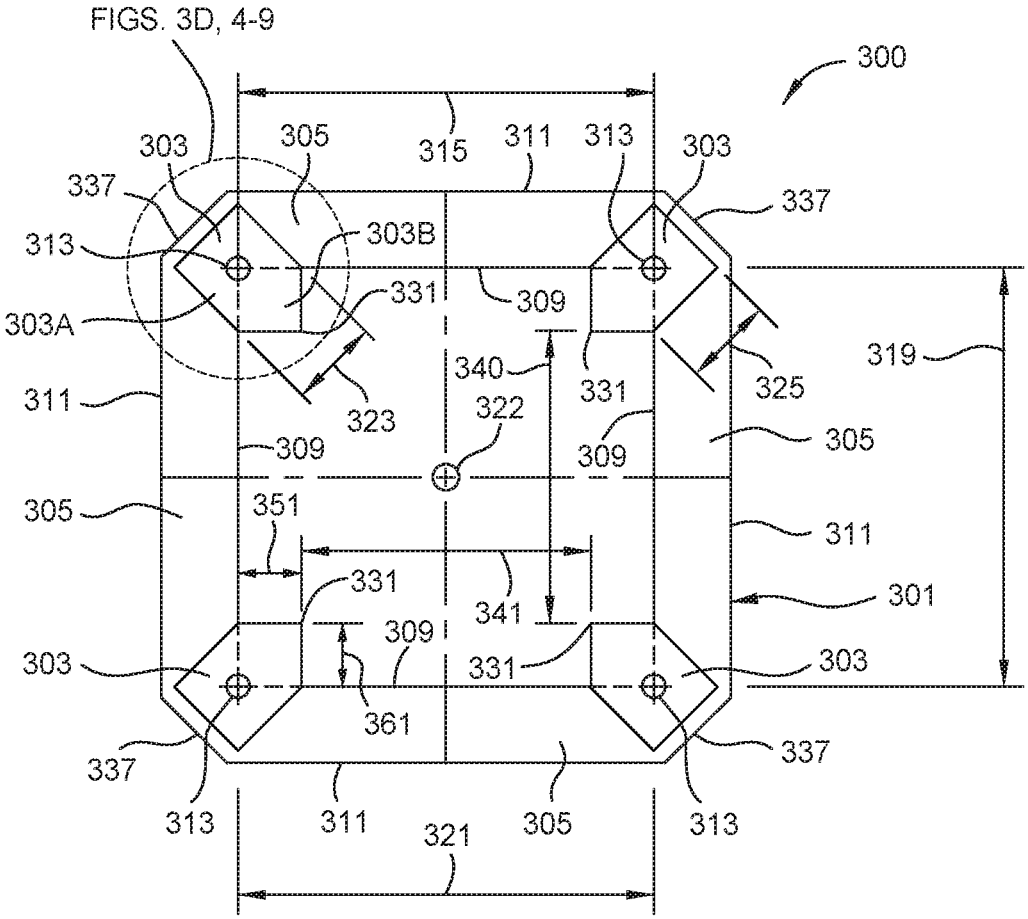
FIG. 3C illustrates a cross-sectional schematic view of the hull illustrated in FIG. 3A, taken along line 3C-3C, according to one implementation.

FIG. 3C illustrates a cross-sectional schematic view of the hull 300 illustrated in FIG. 3A, taken along line 3C-3C, according to one implementation. Each of the four sides 305 of the pontoon 301 disposed in a rectangular arrangement has an inner edge 309 and an outer edge 311. Each of the columns 303 includes an axial centerline 313 (also illustrated in FIG. 3A) that extends vertically through the respective column 303. The hull 300 includes a center 322 and a center axis 335 (illustrated in FIG. 3A) that extends vertically through the center 322. A center-to-center spacing 315 is measured between the axial centerlines 313 of the columns 303. The center-to-center spacing 315 illustrated in FIG. 3C can be the same as the center-to-center spacing 115, 215 illustrated in FIGS. 1 and 2, respectively.

The columns 303 are rotated about their respective axial centerlines 313 by 45 degrees towards the center 322 of the hull 300 such that an apex 331 of each column 303 points inboard towards the center 322 of the hull 300. Each column 303 has a cross section that includes a first portion 303A and a second portion 303B. The second portion 303B extends inboard from the first portion 303A towards the center 322 of the hull 300. An apex 331 of the column 303 is defined by the innermost edge of the second portion 303B of the cross section of the column 303, as illustrated in FIG. 3C. The apex 331 extends inboard from the first portion 303A towards the center 322 of the hull 300. The inner edges 309 of the sides 305 of the pontoon 301 define an inner perimeter of the pontoon 301. The apex 331 of each column 303 is disposed within the inner perimeter defined by the inner edges 309.

The pontoon 301 includes four corner edges 337 that are disposed outside of the columns 303. The corner edges 337 and the outer edges 311 of the sides 305 of the pontoon 301 define an outer perimeter of the pontoon 301. The columns 303 are disposed at or within the outer perimeter of the pontoon 301. In one example, each corner edge is parallel with a side of a respective column 303.

The outer perimeter of the topsides 330 (illustrated in FIG. 3A) is within the outer perimeter defined by the outer edges 311 of sides 305. In one example, the outer perimeter of the topsides 330 (illustrated in FIG. 3A) is within the inner perimeter defined by the inner edges 309 of the sides 305. In one embodiment, which can be combined with other embodiments, at least two of the sides 332 of the topsides 330 are disposed within the inner perimeter defined by the inner edges 309 of the sides 305 of the pontoon 301. In one example, two opposing sides 332 of the topsides 330 are disposed within the inner perimeter defined by the inner edges 309 of the sides 305 of the pontoon 301. In one example, four sides 332 of the topsides 330 are disposed within the inner perimeter defined by the inner edges 309 of the sides 305 of the pontoon 301 (as illustrated in FIG. 3A).

The present disclosure contemplates that the first portions 303A and second portions 303B of respective cross sections of columns 303 can be formed from a single body or two or more bodies. As an example, the first portion 303A and second portion 303B of the cross section of each column 303 may be formed from a single body or from two or more bodies.

A pontoon spacing width 319 is measured between the inner edges 309 of opposing sides 305 of the pontoon 301. A pontoon spacing length 321 is measured between the inner edges 309 of the other two opposing sides 305. A support point width 340 (e.g., the distance between adjacent support ports) is measured between the apexes 331 that are spaced from each other in a direction along the pontoon spacing width 319. A support point length 341 is measured between the apexes 331 that are spaced from each other in a direction along the pontoon spacing length 321. The support point width 340 is lesser than the pontoon spacing width 319. The support point length 341 is lesser than the pontoon spacing length 321.

The apex 331 of each column 303, and hence a support point of each column 303, is disposed at a length gap 351 measured from the inner edge 309 of the nearest side 305 of the pontoon 301 in a direction along the pontoon spacing length 321. The apex 331 of each column 303, and hence a support point of each column 303, is disposed at a width gap 361 measured from the inner edge 309 of the nearest side 305 of the pontoon 301 in a direction along the pontoon spacing width 319.

In one example, one or both of the length gap 351 and/or the width gap 361 are each 3 meters or larger. In one example, one or both of the length gap 351 and/or the width gap 361 are each within a range of 5 meters to 15 meters.

The second portion 303B of the cross section of each column 303 that extends inboard allows for the pontoon 301 to be widened to improve hydrodynamic performance while keeping the same or reducing the distances between support points for the topsides 330 (illustrated in FIG. 3A). This improves hydrodynamic performance of the semi-submersible 399 and reduces the size, complexity, and/or weight of the topsides 330 to be supported by the columns 303, resulting in costs benefits and beneficial hydrodynamic performance. The columns 303 can achieve these benefits with the same center-to-center spacing as other semi-submersible hulls, such as those illustrated in FIGS. 1 and 2. This allows the hull 300 to operate in conjunction with the same vessels that would float over the hull 300 to install a topsides because the center-to-center spacing 315 is not reduced less than the size of the vessel carrying the topsides. The cross sectional areas of the columns 303 can also be about the same as other columns, such as those illustrated in FIGS. 1 and 2.

As an example, one or more of a width 323 and/or a length 325 of the first portion 303A of each column 303 can be shorter than the column width 223 and column length 225 illustrated in FIG. 2, with the overall cross sectional area of column 303 having about the same overall cross sectional area of column 203. This allows the columns 303 to support the same or extra weight when compared to other hulls. Having the same cross sectional area also allows for the axial centerlines 313 to be placed near the same locations as axial centerlines of other configurations, such as the axial centerlines 213 illustrated in FIG. 2. Allowing for placement of the axial centerlines 313 in similar locations as other configurations allows for a similar center-to-center spacing 315 and for the hull 300 to accommodate the same topsides 330 as other configurations. Such placement also promotes stability and hydrodynamic performance of the hull 300. The length 325 of the first portion 303A is in a radial direction towards the center 322 of the hull 300.

The inboard extending second portions 303B of the columns 303 allow for wider spacing between sides 305 of pontoon 301 (such as pontoon spacing length 321 and/or pontoon spacing width 319) without widening spacing between support points for topsides 330 (such as support point width 340 and/or support point length 342). This results in beneficial hydrodynamic performance for semi-submersible 399 because a wider pontoon 301 may be used without significantly increasing the size and/or weight of the topsides 330. The configurations described can achieve these benefits without the need to significantly change other design parameters of the semi-submersible 399, such as one or more of draft, center-to-center spacing 315, freeboard, cross sectional area of columns 303, pontoon 301 height, metacentric height, and/or topsides 330 shape. Hence, the semi-submersible 399 can utilize the same topsides as other semi-submersible designs. The present disclosure contemplates that one or more of these design parameters may also be changed in addition to utilizing the configurations described herein.

The inboard extending second portions 303B of the columns 303 also allow flexibility in specifying the size and shape of the hull 300 while reducing or minimizing the resulting negative effects on hydrodynamic performance. As an example, outer edges and corner edges of the pontoon 301 may be placed outside outer edges of the columns 303 without significantly increasing the width of sides 305, which would significantly increase wave load due to increased surface area of sides 305 of pontoon 301. The inboard extending second portions 303B of the columns 303 and/or the apexes 331 also operate to disperse ocean waves that are moving into the apexes 331, such as in a direction from the center 322 of the hull 300 towards the respective apex 331. The dispersing of ocean waves by the columns 303 results in less wave load on the columns 303, which allows for a reduced height of the columns 303 compared to other semi-submersible designs. As an example, aspects of the columns 303 illustrated in FIG. 3C allow for a height reduction for the columns 303 of 5 percent, such as a height reduction of 1 meter. The reduced height involves beneficial hydrodynamic performance, cost savings, and weight savings.

Figure 3D:
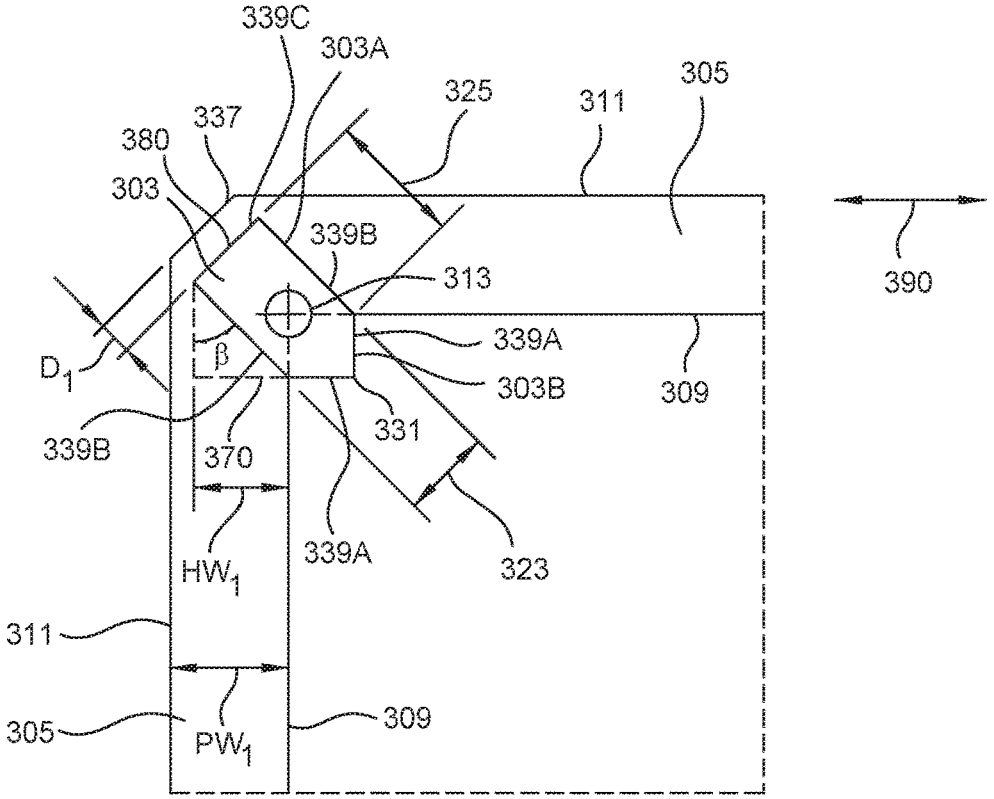
FIG. 3D is an enlarged schematic view of the hull illustrated in FIG. 3C, according to one implementation.

FIG. 3D is an enlarged schematic view of the hull 300 illustrated in FIG. 3C, according to one implementation. In the example illustrated, the first portion 303A of the cross section (in a plane perpendicular to an axial centerline) of each column 303 is rectangular and the second portion 303B is triangular. The term "rectangular," as is used throughout the present disclosure, includes both rectangle shapes and square shapes, unless specified otherwise. The second portion 303B is a right-angled triangle, but other triangular shapes, including acute or obtuse, are also contemplated. The shape and size of the first portion 303A and/or the second portion 303B can be specified based on a beneficial area of the cross section, the locations of supporting points for the topsides 330, and/or the preferences of a hull manufacturing facility.

The cross section of each column 303 has at least five sides 339A-339C (five are shown). At least two of the sides 339A (two are shown) are disposed within the inner perimeter defined by the inner edges 309 of the pontoon 301. The columns 303 are disposed within the outer perimeter defined by the outer edges 311. The outermost side 339C defines an outer edge 380 for each column 303. Each column 303 is disposed at a distance $D_1$ from the adjacent corner edge 337 of the pontoon 301. The corner edge 337 is disposed outside of the outer edge 380 of an adjacent column 303. In one example, the distance $D_1$ is measured between the adjacent corner edge 337 and the outer edge 380 of the respective column 303, and the adjacent corner edge 337 extends outside of the outer edge 380 of the respective column 303. A side width $PW_1$ of the pontoon 301 is measured between an inner edge 309 of a side 305 and an adjacent outer edge 311 of the respective side 305. The side width $PW_1$ is larger than a horizontal width $HW_1$ of the first portion 303A of the cross section of the column 303. The horizontal width $HW_1$ is measured along a horizontal profile 370 of the first portion 303A of the cross section of the column 303. This configuration can provide beneficial hydrodynamic performance for the semi-submersible 399 by providing a relatively wide pontoon 301.

In one example, the horizontal width $HW_1$ is determined using the following equation:

$$HW_1=(CL)\times\sin(\beta) \quad \text{(Equation 1)}$$

where CL is the length 325 of the first portion 303A of the column 303, and δ is equal to the angle of orientation of the column 303 relative to a horizontal axis 390.

Figure 4:
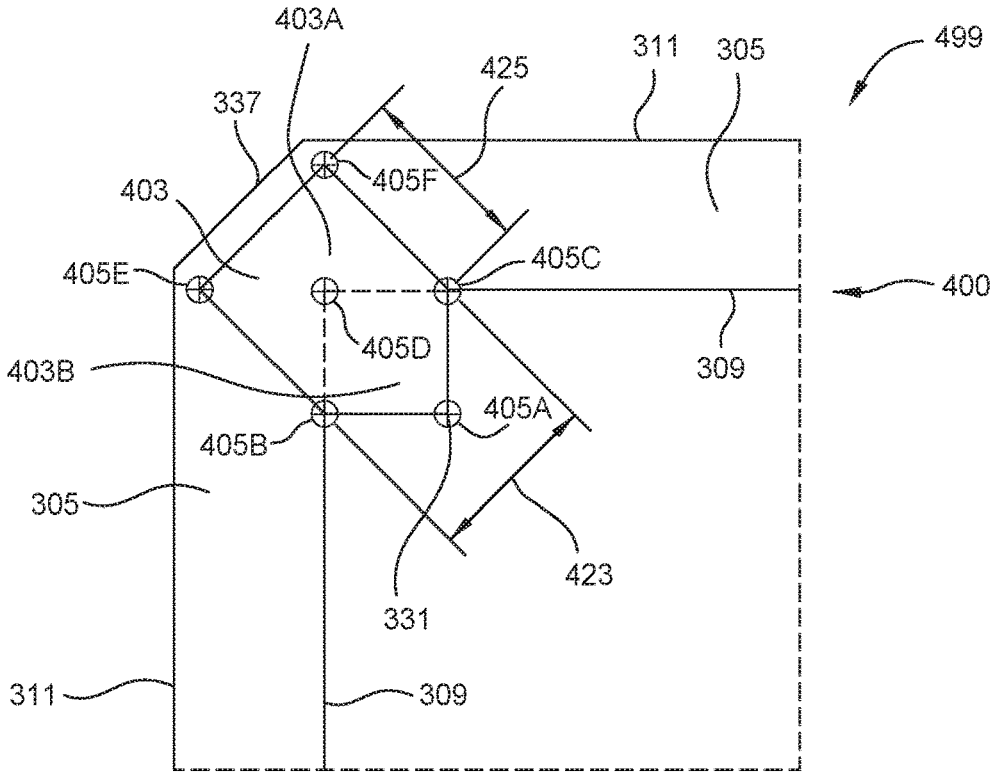
FIG. 4 is an enlarged schematic top view of a hull of a semi-submersible, according to one implementation.

FIG. 4 is an enlarged schematic top view of a hull 400 of a semi-submersible 499, according to one implementation. The hull 400 and the semi-submersible 499 are similar to the hull 300 and semi-submersible 399 described above, respectively, and may include one or more of the features, aspects, components, and/or properties thereof. The hull 400 includes four columns 403. The columns 403 are similar to the columns 303 described above, and may include one or more of the features, aspects, components, and/or properties thereof. Each of the columns 403 has a cross section including a first portion 403A and a second portion 403B that extends inboard from the first portion 403A towards the center 322 of the hull 400. The first portion 403A is square in shape such that a width 423 of the first portion 403A is about equal to a length 425 of the first portion 403A (in contrast to the first portion 303A which is rectangular and has a length 325 that is larger than the width 323). The second portion 403B is triangular in shape, such as a right-angled triangle. Each column 403 includes one or more support point locations 405A-405F at which a support point and/or a deck post (such as the deck post 329 described above) may be located. A support point location 405A is located adjacent to or at the apex 331 of each column 403. A support point location 405D is located at the axial centerline of each column 403.

Figure 5:
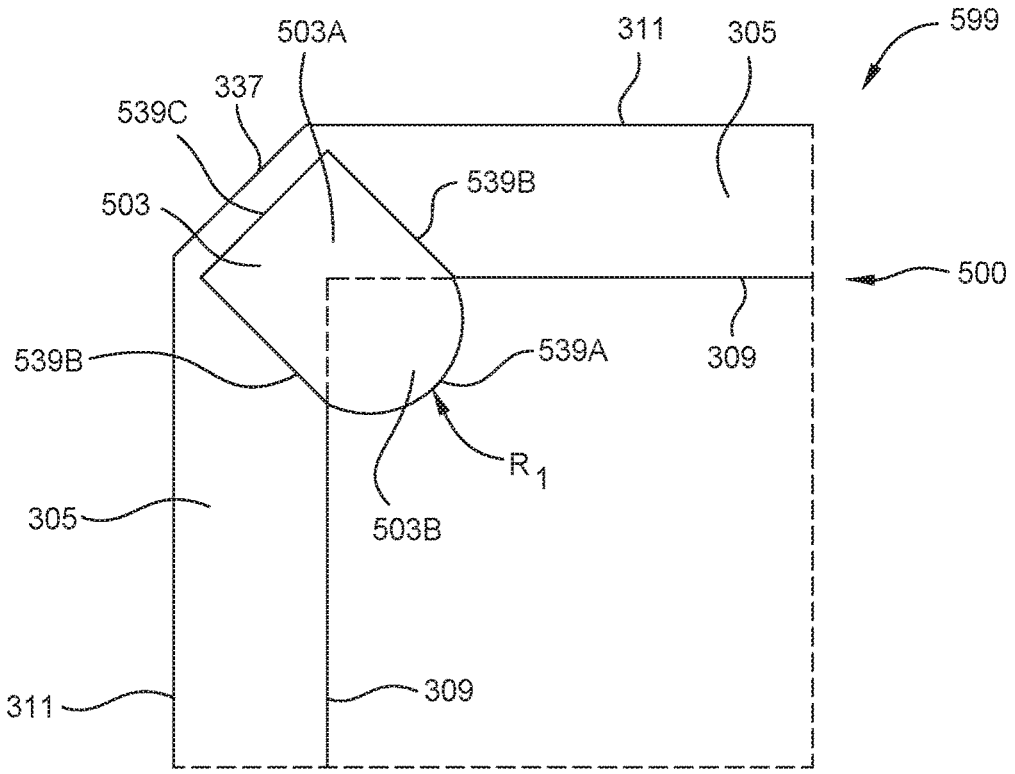
FIG. 5 is an enlarged schematic top view of a hull of a semi-submersible, according to one implementation.

FIG. 5 is an enlarged schematic top view of a hull 500 of a semi-submersible 599, according to one implementation. The hull 500 and the semi-submersible 599 are similar to the hull 300 and semi-submersible 399 described above, respectively, and may include one or more of the features, aspects, components, and/or properties thereof. The hull 500 includes four columns 503. The columns 503 are similar to columns 303 and 403 described above, and may include one or more of the features, aspects, components, and/or properties thereof. Each of the columns 503 has a cross section including a first portion 503A and a second portion 503B that extends inboard from the first portion 503A towards the center 322 of the hull 500. The first portion 503A is rectangular in shape, such as a rectangle or a square. The second portion 503B is circular in shape (such as semi-circular in shape) or elliptical in shape (such as semi-elliptical in shape). A diameter of the second portion 503B is about equal to a width of the first portion 503A. The cross section of each column 503 includes four sides 539A-539C. The innermost side 539A is arcuate in shape, such as semi-circular in shape or semi-elliptical in shape. The innermost side 539A of the cross section is at least partially defined by a radius $R_1$. The innermost side 539A is disposed within the inner perimeter defined by the inner edges 309 of the pontoon 301.

Figure 6:
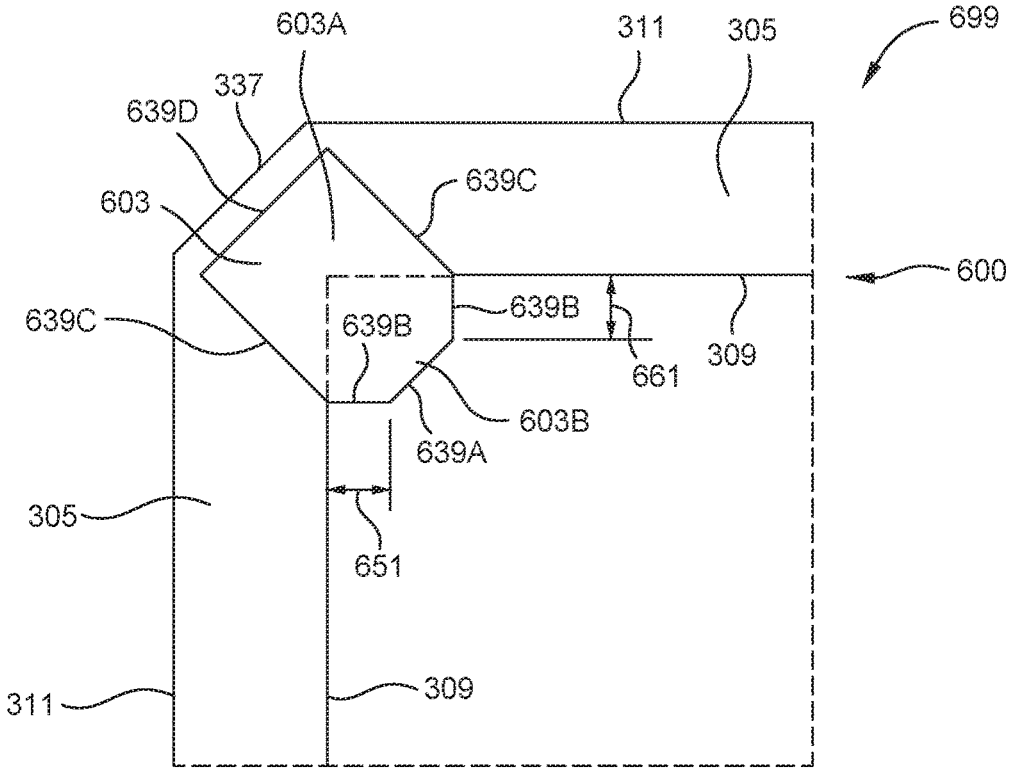
FIG. 6 is an enlarged schematic top view of a hull of a semi-submersible, according to one implementation.

FIG. 6 is an enlarged schematic top view of a hull 600 of a semi-submersible 699, according to one implementation. The hull 600 and the semi-submersible 699 are similar to the hull 300 and semi-submersible 399 described above, respectively, and may include one or more of the features, aspects, components, and/or properties thereof. The hull 600 includes four columns 603. The columns 603 are similar to columns 303, 403, and 503 described above, and may include one or more of the features, aspects, components, and/or properties thereof. Each of the columns 603 has a cross section including a first portion 603A and a second portion 603B that extends inboard from the first portion 603A towards the center 322 of the hull 600. The first portion 603A is rectangular in shape, such as a rectangle or a square. The second portion 603B is trapezoidal in shape. The cross section of each column 603 includes at least five sides 639A-639D (six are shown in FIG. 6). At least three of the sides 639A, 639B are disposed within the inner perimeter defined by the inner edges 309 of the pontoon 301. The innermost side 639A of each column 603 that faces the center 322 of the hull 600. The innermost side 639A of the second portion 603B of each column 603, and hence a support point of each column 603, is disposed at a length gap 651 measured from the inner edge 309 of the nearest side 305 of the pontoon 301 in a direction along the pontoon spacing length 321. The innermost side 639A of the second portion 603B of each column 603, and hence a support point of each column 603, is disposed at a width gap 661 measured from the inner edge 309 of the nearest side 305 of the pontoon 301 in a direction along the pontoon spacing width 319.

In one example, one or both of the length gap 651 and/or the width gap 661 are each 3 meters or larger, such as 3 meters.

Figure 7:
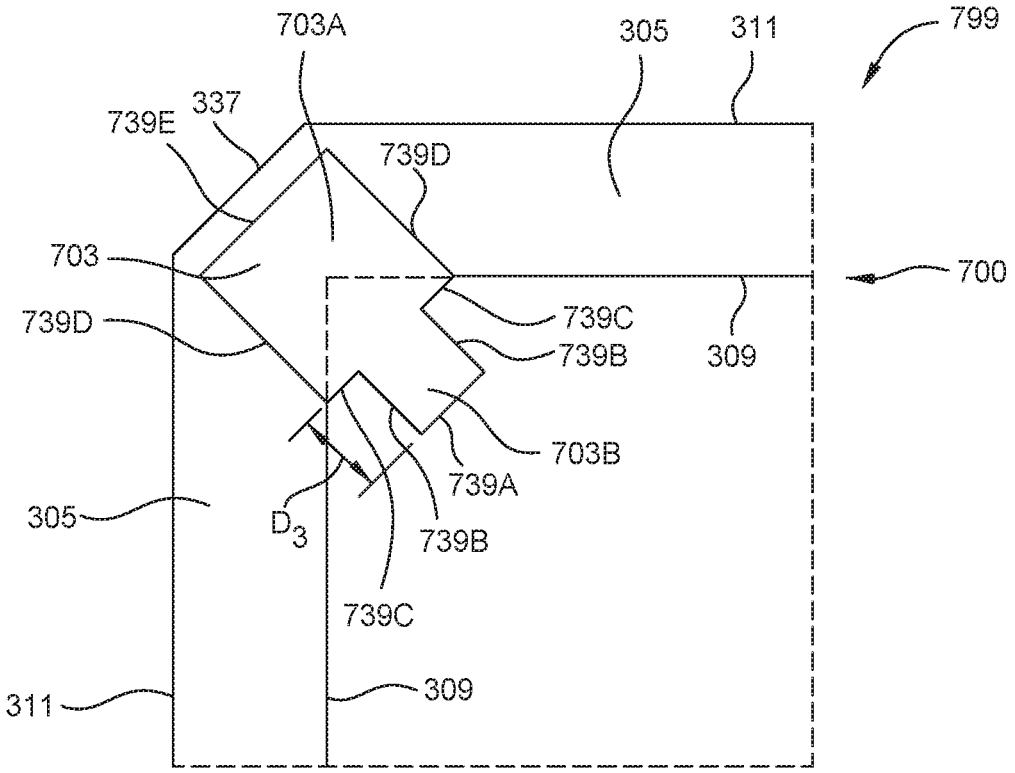
FIG. 7 is an enlarged schematic top view of a hull of a semi-submersible, according to one implementation.

FIG. 7 is an enlarged schematic top view of a hull 700 of a semi-submersible 799, according to one implementation. The hull 700 and the semi-submersible 799 are similar to the hull 300 and semi-submersible 399 described above, respectively, and may include one or more of the features, aspects, components, and/or properties thereof. The hull 700 includes four columns 703. The columns 703 are similar to columns 303, 403, 503, and 603 described above, and may include one or more of the features, aspects, components, and/or properties thereof. Each of the columns 703 has a cross section including a first portion 703A and a second portion 703B that extends inboard from the first portion 703A towards the center 322 of the hull 700. The first portion 703A is rectangular in shape, such as a rectangle or a square. The second portion 703B is rectangular in shape, such as a rectangle or a square. The cross section of each column 703 includes eight sides 739A-739E. At least four of the sides 739A-739C (five are shown) are disposed within the inner perimeter defined by the inner edges 309 of the pontoon 301. The innermost side 739A of each column 703 faces the center 322 of the hull 700. The innermost side 739A of the second portion 703B extends from the first portion 703A by a distance $D_3$. In one example, the second portion 703B is smaller than the first portion 703A such that an area of the second portion 703B is less than an area of the first portion 703A. At least one of the sides 739B of the second portion 703B of the cross section (two are shown) is perpendicular to a respective side 739C of the first portion 703A that is disposed adjacent to the respective side 739B. In one example, the respective side 739B of the second portion 703B is disposed at a 90 degree angle relative to the respective adjacent side 739C of the first portion 703A.

Figure 8:
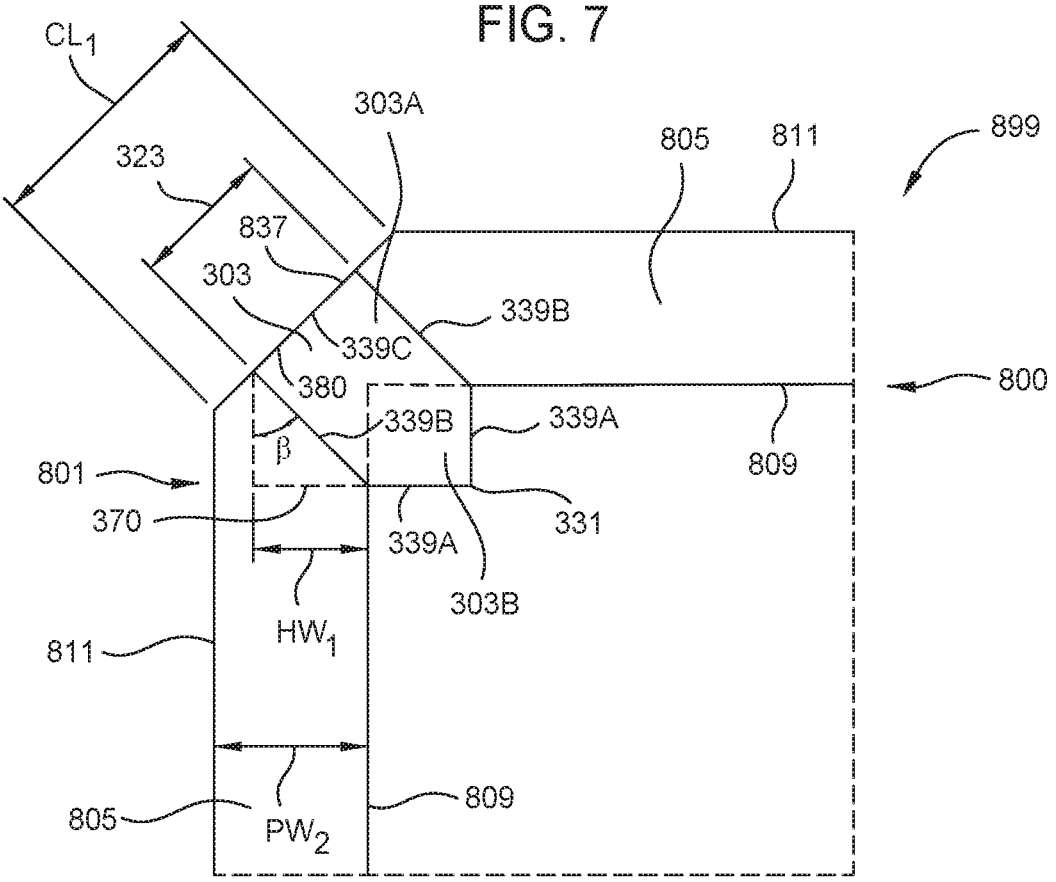
FIG. 8 is an enlarged schematic top view of a hull of a semi-submersible, according to one implementation.

FIG. 8 is an enlarged schematic top view of a hull 800 of a semi-submersible 899, according to one implementation. The hull 800 and the semi-submersible 899 are similar to the hull 300 and semi-submersible 399 described above, respectively, and may include one or more of the features, aspects, components, and/or properties thereof. The hull 800 includes a pontoon 801. The pontoon 801 is similar to pontoon 301 described above, and may include one or more of the features, aspects, components, and/or properties thereof. The pontoon 801 includes four sides 805. Each side 805 includes an inner edge 809 and an outer edge 811. The pontoon 801 includes four corner edges 837, each of which is disposed adjacent to a respective column 303. Each corner edge 837 is disposed in alignment with the outer edge 380 of the respective column 303 such that the outer edge 380 is not disposed at a distance from the respective corner edge 837. A side width $PW_2$ of the pontoon 801 is measured between an inner edge 809 and an outer edge 811 of a side 805. Each corner edge 837 defines a corner edge length $CL_1$ that is larger than the width 323 of the first portion 303A of the cross section of the respective column 303. In the example illustrated in FIG. 8, the side width $PW_2$ is larger than the horizontal width $HW_1$ of the first portion 303A of the cross section of the column 303 and the outer edge 380 is aligned with the corner edge 837 of the pontoon 801. In one embodiment, which can be combined with other embodiments, a width of the outer edge 380 of each column 303 is equal to the width 323 of the first portion 303A of the cross section of the respective column 303. This configuration allows for beneficial hydrodynamic performance of the semi-submersible 899 by allowing for a wider pontoon 801 while reducing the wave load on the pontoon 801 due to reduced outer surface area of the pontoon 801.

Figure 9:
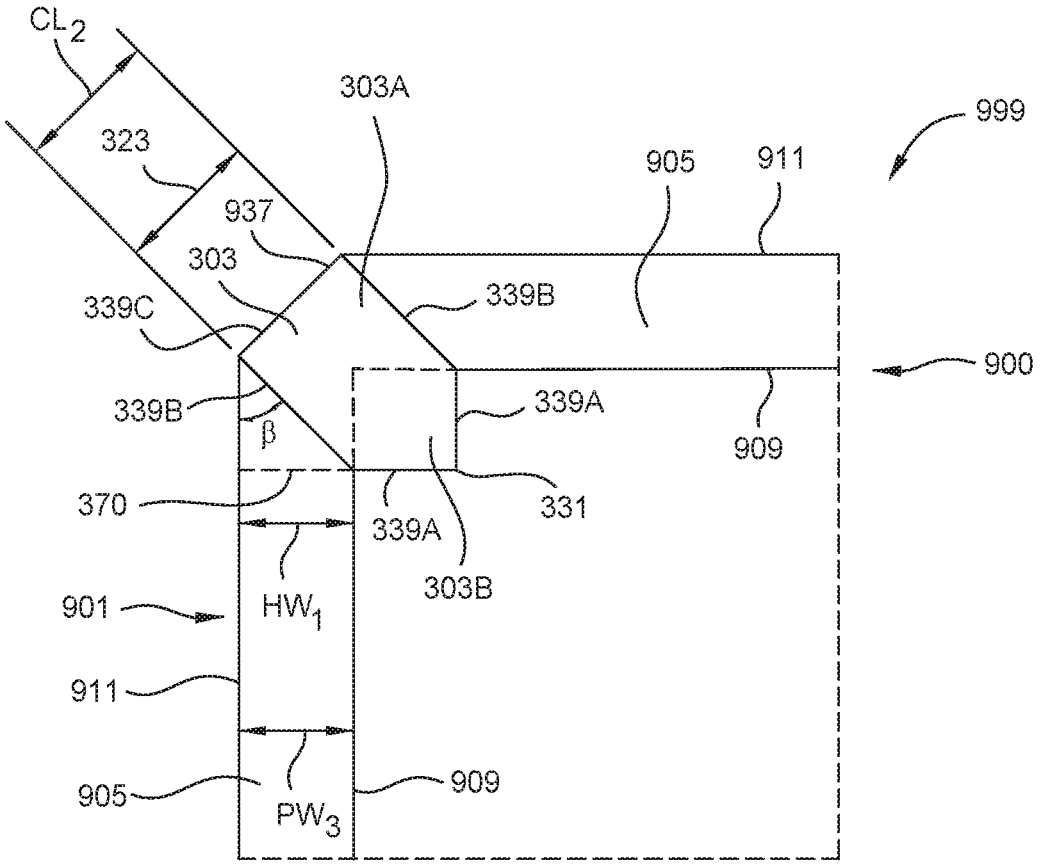
FIG. 9 is an enlarged schematic top view of a hull of a semi-submersible, according to one implementation.

FIG. 9 is an enlarged schematic top view of a hull 900 of a semi-submersible 999, according to one implementation. The hull 900 and the semi-submersible 999 are similar to the hull 300 and semi-submersible 399 described above, respectively, and may include one or more of the features, aspects, components, and/or properties thereof. The hull 900 includes a pontoon 901. The pontoon 901 is similar to pontoons 301 and 801 described above, and may include one or more of the features, aspects, components, and/or properties thereof. The pontoon 901 includes four sides 905. Each side 905 includes an inner edge 909 and an outer edge 911. The pontoon 901 includes four corner edges 937, each of which is disposed adjacent to a respective column 303. Each corner edge 937 is disposed in alignment with the outer edge 380 of the respective column 303 such that the outer edge 380 is not disposed at a distance from the respective corner edge 937. A side width $PW_3$ of the pontoon 901 is measured between an inner edge 909 and an outer edge 911 of a side 905. Each corner edge 937 defines a corner edge length $CL_2$ that is larger than the width 323 of the first portion 303A of the cross section of the respective column 303. In the example illustrated in FIG. 9, the side width $PW_3$ is about equal to the horizontal width $HW_1$ of the first portion 303A of the cross section of the column 303 and the outer edge 380 is aligned with the corner edge 937 of the pontoon 901.

Aspects of the present disclosure allow for beneficial hydrodynamic performance of the semi-submersible 999 by allowing flexibility of the design of the hull 900. As an example, aspects of the present disclosure allow for the side width $PW_3$ to be designed independently of the horizontal width $HW_1$. In one example, hydrodynamic performance of the semi-submersible 999 is achieved by allowing for a wider pontoon 901 while reducing the wave load on the pontoon 901 due to reduced outer surface area of the pontoon 901.

Figure 10:
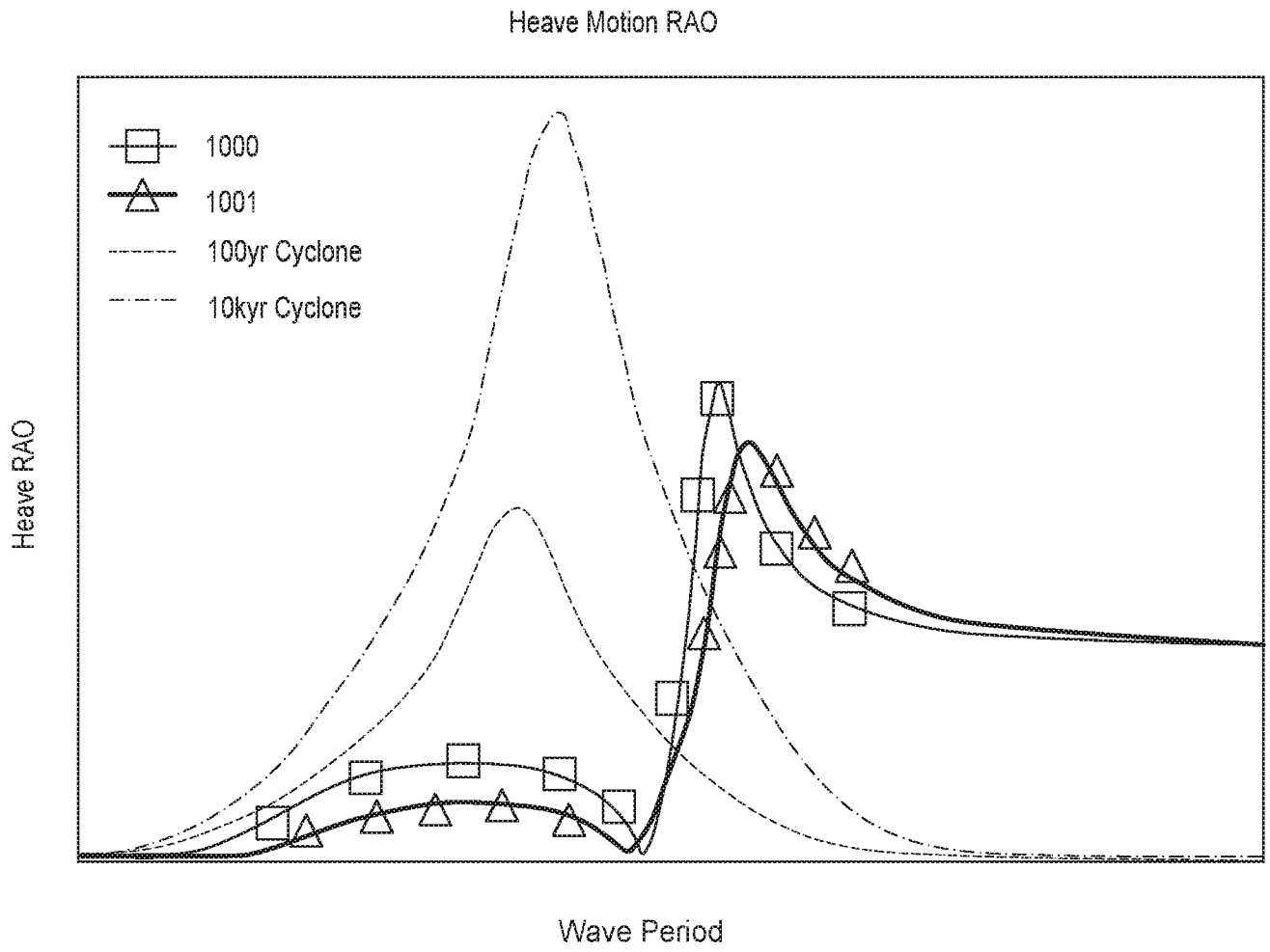
FIG. 10 illustrates a graph showing the heave Response Amplitude Operators (RAO's) of a semi-submersible.

FIG. 10 illustrates a graph showing the heave Response Amplitude Operators (RAO's) of a semi-submersible 1001. The semi-submersible 1001 has columns having a cross section that includes a first portion and a second portion extending inboard from the first portion towards the center of the hull. The graph also shows the RAO's of a conventional semi-submersible 1000, a wave spectrum in a 100 year offshore environment and a wave spectrum in a 10,000 year environment. The semi-submersible 1001 with columns having an inboard-extending portion incurs less heave motion response than the conventional semi-submersible 1000, such as 32% heave motion in a 10-year operating offshore environment. The reduced heave motion also involves less heave velocity and less heave acceleration as compared to conventional semi-submersible designs, indicating that the semi-submersible 1001 would have increased strength and fatigue life than the conventional semi-submersible 1000. Certain design parameters of the semi-submersible 1001 and the conventional semi-submersible 1000 are about the same, such as draft, column center-to-center spacing, freeboard, column cross section area, pontoon height, and metacentric height.

Benefits of the present disclosure include one or more of widening spacing within a pontoon relative to spacing between support points for a topsides; widening spacing within a pontoon while keeping the same, or reducing, spacing between support points for a topsides; widening a width of sides of a pontoon; reduced heave response for a semi-submersible, including heave motion, heave velocity, and/or heave acceleration; beneficial hydrodynamic performance; reduced topsides weight, size, and complexity; reduced column height; maintained or increased metacentric height; the ability to float a hull of a semi-submersible in shallower drafts; less wave load; reduced vortex motion of a semi-submersible; ease of installation of risers on a pontoon; increased fatigues life of mooring lines and risers; reduced manufacturing difficulties; and reduced manufacturing costs.

Aspects of the present disclosure include columns having at least five sides; columns with a cross section having a first portion and a second portion that extends inboard from the first portion towards a center of a hull; a cross section having an inner edge of a second portion that extends from a first portion by a distance; vertical columns; a support point width that is lesser than a pontoon spacing width; a support point length that is lesser than a pontoon spacing length; columns having an inner edge that is disposed within an inner perimeter of a pontoon; deck posts; a pontoon having corner edges that are outside of outer edges of columns; a pontoon having corner edges that are aligned with outer edges of columns; and columns having a cross section including at least two sides that are disposed within an inner perimeter of a pontoon. It is contemplated that one or more of these aspects disclosed herein may be combined. Moreover, it is contemplated that one or more of these aspects may include some or all of the aforementioned benefits.

While the foregoing is directed to embodiments of the present disclosure, other and further embodiments of the disclosure may be devised without departing from the basic scope thereof. The present disclosure also contemplates that one or more aspects of the embodiments described herein may be substituted in for one or more of the other aspects described. The scope of the disclosure is determined by the claims that follow.

What is claimed is:

1. A hull for a semi-submersible, comprising:
a pontoon having one or more sides; and
a plurality of columns extending upwards from the pontoon and configured to support a topsides, each one of the plurality of columns having a cross section that is in a plane perpendicular to an axial centerline of the respective one of the plurality of columns, wherein each one of the plurality of columns is rotated about the respective axial centerline by 45 degrees, the cross section comprising:
a first portion being rectangular in shape, and
a second portion being triangular in shape and having an apex that extends inboard from the first portion, the second portion including an innermost side that is arcuate in shape.

2. The hull of claim 1, wherein the pontoon has at least two sides and a pontoon spacing width between inner edges of two opposing sides, wherein each one of the plurality of columns includes a support point that supports the topsides, and the support points of the plurality of columns are spaced from each other at a support point width in a direction along the pontoon spacing width, and the support point width is lesser than the pontoon spacing width.

3. The hull of claim 2, wherein the pontoon has four sides and a pontoon spacing length between inner edges of two other opposing sides of the four sides, and the support points of the plurality of columns are spaced from each other at a support point length in a direction along the pontoon spacing length, and the support point length is lesser than the pontoon spacing length.

4. The hull of claim 3, wherein each one of the plurality of columns includes a deck post at the support point of the respective one of the plurality of columns.

5. The hull of claim 1, further comprising a center axis that extends vertically through the hull, wherein the plurality of columns are oriented vertically such that the axial centerline of each of the plurality of columns is parallel to the center axis of the hull.

6. A hull for a semi-submersible, comprising:
a pontoon having one or more sides; and
a plurality of columns extending upwards from the pontoon and configured to support a topsides, each one of the plurality of columns having a cross section that is in a plane perpendicular to an axial centerline of the respective one of the plurality of columns, the cross section comprising:
a first portion being square in shape,
a second portion being triangular in shape and having an apex that extends inboard from the first portion, and
five sides.

7. A hull for a semi-submersible, comprising:
a pontoon having one or more sides; and
a plurality of columns extending upwards from the pontoon and configured to support a topsides, each one of the plurality of columns having a cross section that is in a plane perpendicular to an axial centerline of the respective one of the plurality of columns, the cross section comprising:
a first portion being rectangular in shape,
a second portion being trapezoidal in shape and having an apex that extends inboard from the first portion, and
six sides.

8. The hull of claim 7, wherein the first portion is square in shape.

9. A hull for a semi-submersible, comprising:
a pontoon having four sides and four corners, each of the four sides having an inner edge and an outer edge, the inner edges of the four sides defining an inner perimeter of the pontoon; and
four columns extending upwards from the pontoon and configured to support a topsides, each one of the four columns being disposed at one of the four corners of the pontoon and having an inner edge disposed within the inner perimeter of the pontoon, an outer edge, and a cross section that is in a plane perpendicular to an axial centerline of the respective one of the four columns, the cross section comprising:
a first portion being rectangular in shape, and
a second portion being trapezoidal or semi-circular in shape and having an apex that extends inboard from the first portion.

10. The hull of claim 9, wherein each of the four corners of the pontoon has a corner edge that is disposed outside of the outer edge of an adjacent one of the four columns such that the adjacent one of the four columns is disposed at a distance from the respective corner edge.

11. The hull of claim 9, wherein the first portion of the cross section of each of the four columns has a horizontal width measured along a horizontal profile of the first portion of the cross section of the respective column, each of the four sides of the pontoon has a side width, and the side width is equal to the horizontal width.

12. The hull of claim 9, wherein the pontoon has a pontoon spacing width between the inner edges of two opposing sides of the four sides, and the inner edges of the four columns are spaced from each other at a support point width in a direction along the pontoon spacing width, and the support point width is lesser than the pontoon spacing width.

13. The hull of claim 12, wherein the pontoon has a pontoon spacing length between inner edges of two other opposing sides of the four sides, and the inner edges of the four columns are spaced from each other at a support point length in a direction along the pontoon spacing length, and the support point length is lesser than the pontoon spacing length.

14. The hull of claim 13, further comprising a center axis that extends vertically through the hull, wherein the four columns are oriented vertically such that the axial centerline of each of the four columns is parallel to the center axis of the hull.

15. The hull of claim 9, wherein the cross section of each of the four columns includes at least two sides that are disposed within the inner perimeter of the pontoon.

* * * * *